United States Patent [19]

Nakatani

[11] Patent Number: 4,586,749

[45] Date of Patent: May 6, 1986

[54] BARBER/BEAUTY CHAIR

[75] Inventor: Masatoshi Nakatani, Osaka, Japan

[73] Assignee: Takara Company, New York, Inc., New York, N.Y.

[21] Appl. No.: 520,825

[22] Filed: Aug. 5, 1983

[51] Int. Cl.[4] ..... A47C 1/02

[52] U.S. Cl. ..... 297/330; 297/71; 297/90

[58] Field of Search ..... 297/330, 71, 90, 91

[56] References Cited

U.S. PATENT DOCUMENTS

| | | | |
|---|---|---|---|
| 2,714,922 | 8/1955 | McKibbon | 297/330 |
| 2,890,743 | 6/1959 | Schliephacke | 297/84 X |
| 3,596,982 | 8/1971 | Grams | 297/71 |
| 3,765,720 | 10/1973 | Sakai | 297/330 |
| 3,792,905 | 2/1974 | Johnson | 297/330 |

FOREIGN PATENT DOCUMENTS

| | | | |
|---|---|---|---|
| 600834 | 6/1978 | Switzerland | 297/330 |

*Primary Examiner*—James T. McCall
*Attorney, Agent, or Firm*—Stephen E. Feldman

[57] ABSTRACT

A pair of link plates, each pivotally connected at one end to a seat base and each pivotally connected at their other ends to a seat plate and seat supported thereby, constrain the seat plate and seat to a rearward and upward movement, or a downward and forward movement, with respect to the seat base. The plunger, of a hydraulic cylinder pivotally carried by the seat base, is pivotally connected to the seat plate so that when actuated it induces movement of the seat plate to its rearward and upward position. A seat back is pivotally connected to the seat base and to armrests carried by the seat plate so that movement of the seat in the upward and rearward direction moves the seat back to a downward position aligned with the seat. A footrest linkage is connected between the seat back and a footrest connected to the seat so that movement of the seat back into its downward position moves the footrest into an upward position aligned with the seat and seat back.

10 Claims, 3 Drawing Figures

BARBER/BEAUTY CHAIR

BACKGROUND OF THE INVENTION-FIELD OF APPLICATION

This invention relates to barber and beauty shop chairs; and more particularly to chairs for barber and beauty shops which are positionable to facilitate washing and/or shampooing of the customer's hair.

BACKGROUND OF THE INVENTION-DESCRIPTION OF THE PRIOR ART

Customers often have their hair washed and/or shampooed when they go to their barber, beauty shop, hair dresser, hair stylist or similar place. This usually requires the customer to assume a position in front of a sink with their head positioned over the sink so that the barber/beautician can wash and/or shampoo the customer's hair; hopefully keeping the customer's clothing dry during the process.

Some barber/beauty seating merely provides a fixed chair or stool upon which the person sits facing the sink. The person must lean forward and bend over to place their head over the sink bowl for washing and/or shampooing. Such seating and the required bending have been found to be uncomfortable for the person and difficult for the barber/beautician.

Other available barber/beautician seating permits the person to bend their head backwards for positioning over a sink. However, such seating has also proved somewhat uncomfortable for the customer and difficult for the barber/beautician. The persons clothing often pulled when so seated for washing and/or shampooing. Additionally, such seating may not be suitably adjustable, and the customer's head does not always assume an appropriate position over the sink; sometimes even striking the sink while being positioned and possibly resulting in a serious head injury.

SUMMARY OF THE INVENTION

It is therefore an object of this invention to provide a new and improved barber/beauty chair.

It is another object of this invention to provide a new and improved reclining barber/beauty chair.

It is yet another object of this invention to provide a new and improved barber/beauty seating for positioning a person to facilitate washing and/or shampooing of their hair.

It is yet still another object of this invention to provide new and improved barber/beauty seating for positioning a person with their head over a sink.

It is yet still a further object of this invention to provide new and improved barber/beauty seating which facilitates positioning a person with their head over a sink for washing and/or shampooing.

This invention involves seating for barber and beauty shops; and contemplates constructing the seating so that by a simple operation the back reclines and seat and footrest raise up and are otherwise positioned in a smooth movement to support the seated person in a somewhat reclined position with their head and hair positionable over a sink for washing and/or shampooing.

Other objects, features, and advantages of the invention in its details of construction and arrangement of parts will be seen from the above, from the following description of the preferred embodiment when considered with the drawing and from the appended claims. In particular, these and other objects and advantages of the present invention will become evident from the description that follows.

BRIEF DESCRIPTION OF THE INVENTION

The present invention is basically characterized by the provision of a barber shop or beauty parlor chair, i.e. a motorized shampoo chair, consisting of a barber/-beauty chair for barber shops and beauty parlors. The present chair is positionable to facilitate washing and/or shampooing of the customer's hair, and generally includes a pair of link plates, each pivotally connected at one end to a seat base and each pivotally connected at their other ends to a seat plate and seat supported thereby, constrain the seat plate and seat to a rearward and upward movement or a downward and forward movement, with respect to the seat base. The plunger, of a hydraulic cylinder pivotally carried by the seat base, is pivotally connected to the seat plate so that when activated it induces movement of the seat plate to its rearward and upward position. A seat back is pivotally connected to the seat base and to armrests carried by the seat plate so that movement of the seat in the upward and rearward direction moves the seat back to a downward position aligned with the seat. A footrest linkage is connected between a seat back and a footrest connected to the seat so that movement of the seat back into its downward position moves the footrest into an upward position aligned with the seat and the seat back.

The present invention more specifically entails a barber/beauty chair including seat base means; seat plate means; seat linkage means connecting the seat plate means to the seat base means and so as to move the seat plate means between a first position with respect to the seat base means and a second position with respect to the seat base means; seat means carried by the seat plate means and moveable therewith between the first position and the second position; the seat means including a footrest; seat back means pivotally connected to the seat base means and pivotally connected to the seat plate means and moveable thereby so that movement of the seat plate means between the first position and the second position moves the seat back means between a first seat back position and a second seat back position; footrest linkage means connected to the seat back means and to the footrest to move the footrest between a first footrest position and a second footrest position upon movement of the seat back means moving between the first seat back position and the second seat back position; and hydraulic means carried by the seat base means an pivotally connected to the seat plate means and having plunger means extendable to move the seat plate means, the seat linkage means, the seat means, the seat back means and the footrest from the first positions thereof to the second positions thereof; the plunger means being retractable to move the seat plate means, the seat linkage means, the seat means, the seat back means and the footrest means from the second positions thereof to the first positions thereof.

The present invention in a preferred embodiment typically contemplates the aformentioned barber/-beauty chair wherein the seat linkage means includes at least one pair of link plates each pivotally connected at a first one of their respective ends to the seat base means, and each pivotally connected at a second one of their respective ends to the seat plate means. In this embodiment of the invention, preferably each link plate of the pair of link plates is arranged in the same plane and spaced one from the other. Typically in this case, the present barber/beauty chair includes two pairs of the link plates, a first one of the pairs of link plates being disposed to one side of the seat plate means and the seat base means, and a second one of the pairs of link plates being disposed to the other side of the seat plate means and the seat base means.

In one embodiment of the basic invention, the barber/beauty chair plunger means includes a pair of plungers each connected to one side of the seat base means. In another embodiment, the present barber/beauty preferably includes footrest linkage means which includes a pair of footrest links disposed in spaced relationship one to the other and each proximate another side of the seat base means.

The present barber/beauty chair in a preferred embodiment includes one armrest which is secured to the seat plate means and is pivotally connected to the seat back means, so that movement of the seat plate means between the first and second positions thereof moves the seat back means between the first and second positions thereof. In this case, typically the second armrest is secured to the seat plate means in spaced relationship to the first armrest, and the second armrest is pivotally connected to the seat back means. Generally in the present barber/beauty chair, the seat means, the seat back means and the footrest in the second positions thereof form a bed-like reclining position for the barber/beauty chair and any person seated therein. Typically the seat base means is disposed on top of hydraulic cylinder means.

The invention accordingly consists in the features of construction, combination of elements, and arrangement of parts which will be exemplified in the device and article of manufacture herein after described, and of which the scope of application is as elucidated supra and as will be indicated in the appended claims. In this regard, numerous alternatives within the scope of the present invention, besides those alternatives, preferred embodiments or modes of practicing the invention mentioned supra, and those to be elucidated infra, will occur to those skilled in the art.

DESCRIPTION OF THE PREFERRED EMBODIMENT

Figure 1:
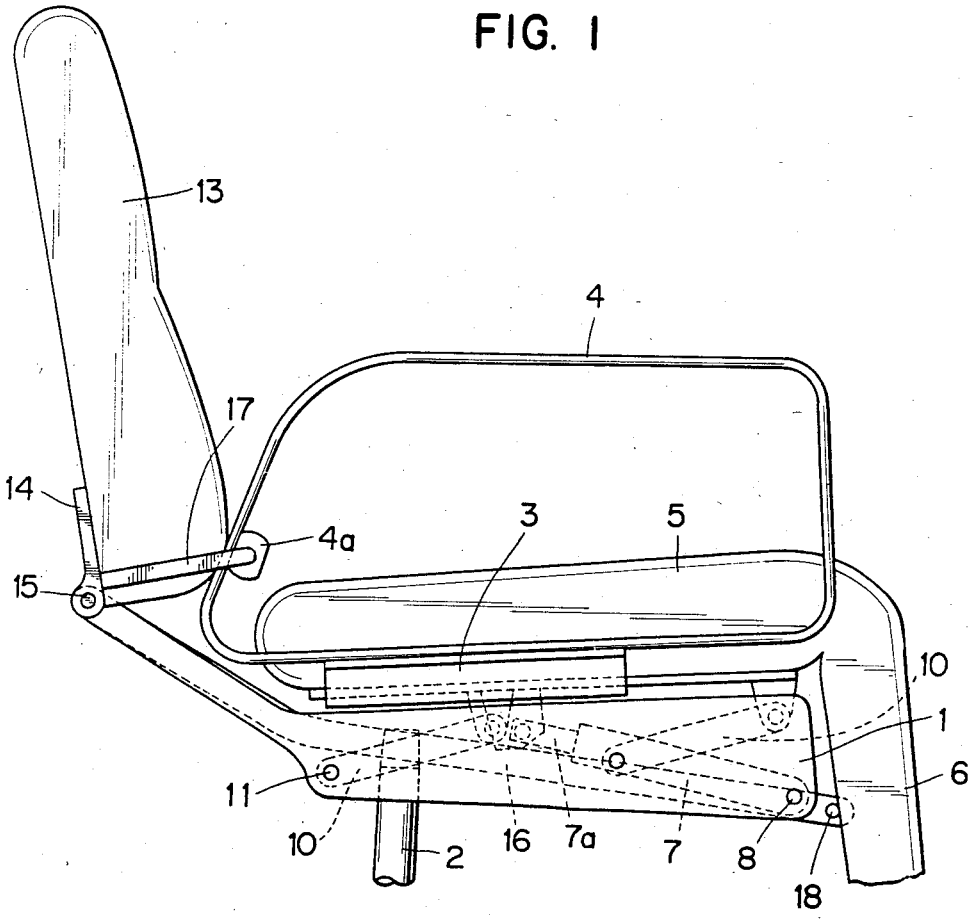
FIG. 1 is a partial schematic elevational view of a barber/beauty chair incorporating the instant invention and showing same in its upright position.
Figure 2:
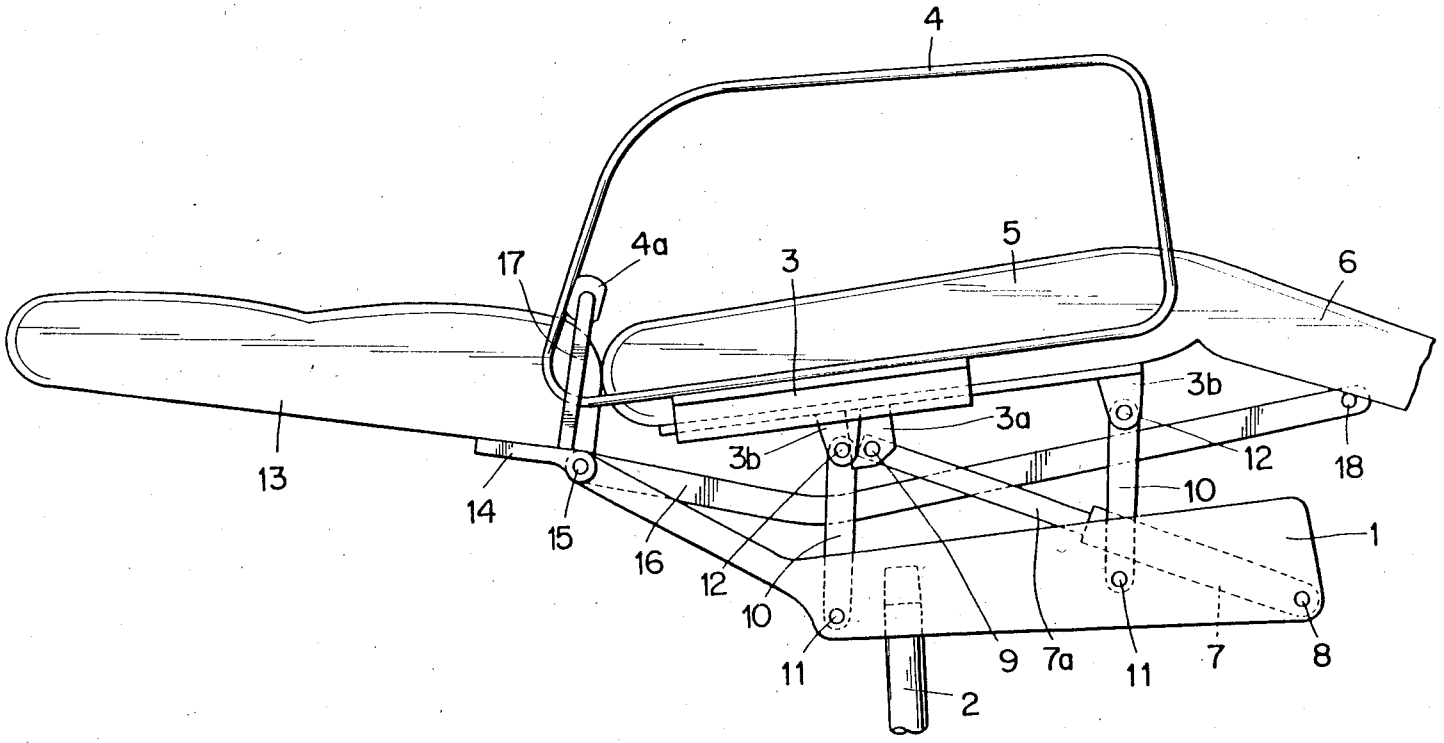
FIG. 2 is a partial schematic elevational view of the chair of FIG. 1 but showing same in its reclined position.
Figure 3:
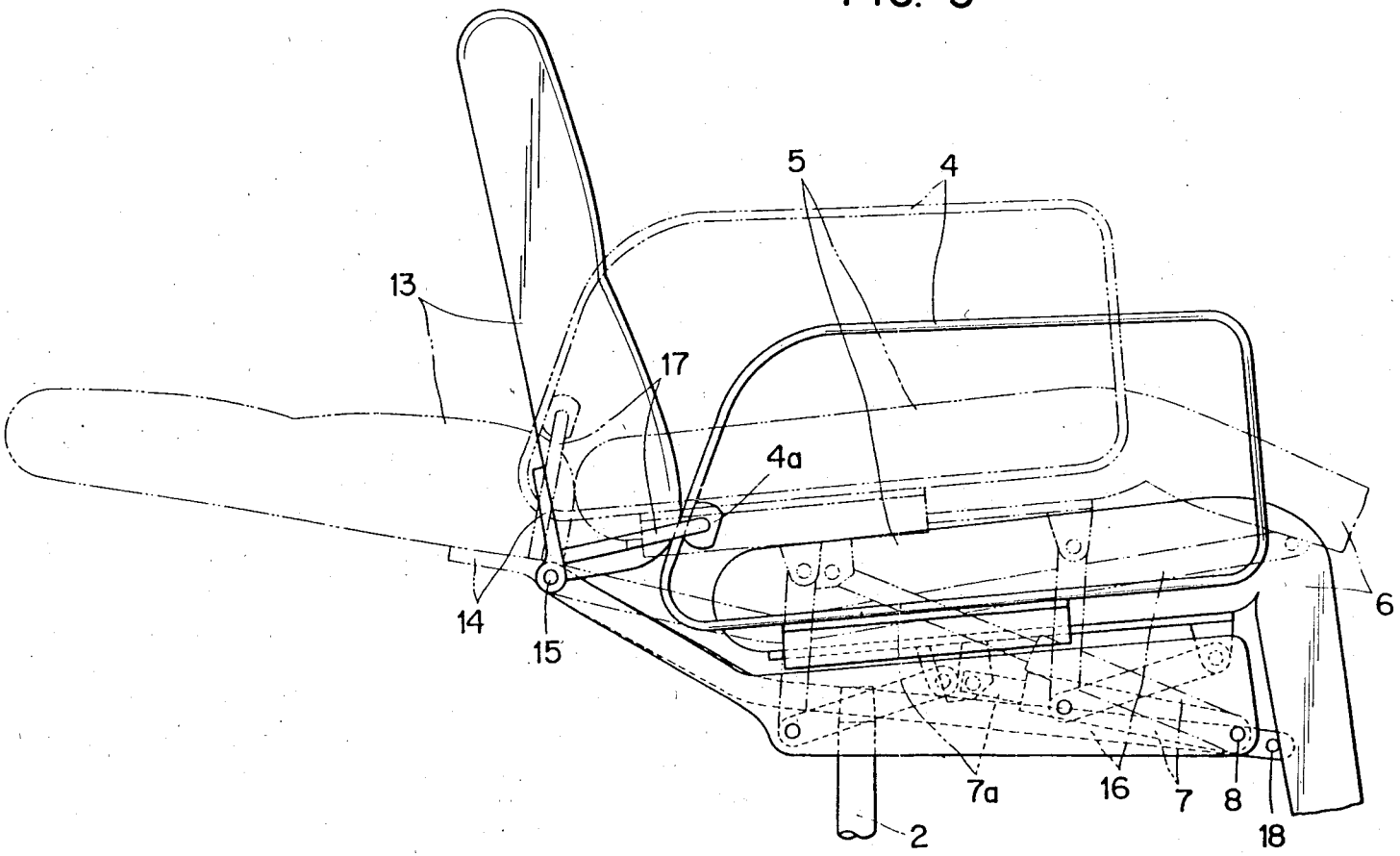
FIG. 3 is a partial schematic elevational view of the chair of FIGS. 1 and 2 showing the chair in its upright position in solid lines and in its reclined position in dot dash lines.

With reference to FIGS. 1–3, there is shown at 1 a seat base supported in conventional manner by a hydraulic cylinder 2 which is, in turn, supported in a conventional manner so as to position seat base 1 with respect to a floor or the like. Hydraulic cylinder 2 is suitably connected to a reservoir of hydraulic fluid (not shown) and to controls (not shown) for raising and lowering its plunger, and for thereby selectively positioning seat base 1 and a seat plate 3 and a seat 5 carried thereby.

Seat 5 is suitably and conventionally secured to seat plate 3 and includes a footrest 6. An armrest 4 is secured to seat plate 3 at each side thereof; their being two such armrests 4 (only one shown) disposed on seat plate 3 each spaced from the other a distance sufficient to permit a person to sit on seat 5 between armrests 4. A pair of ears **3*b* are connected to and extend down from seat plate 3. A pair of link plates 10 each have one of their ends connected by pivots 12 to ears 3*b* and their other ends connected by pivots 11 to seat base 1**.

If only a single set of ears **3*b*, link plates 10, and pivots 11 and 12 are utilized they are centrally disposed beneath and secured to seat plate 3 and seat base 1. Alternatively, ears 3*b*, link plates 10, and pivots 11 and 12 are connected to seat base plate 3 proximate one side thereof; and a second set (not shown) of ears, similar to ears 3*b*, link plates, similar to link plates 10, and pivots, similar to pivots 11 and 12, are secured to seat plate 3 and seat base 1 in spaced relation to the first set and proximate the other side of seat plate 3**.

Another ear **3*a* is connected to and extends down from seat plate 3, and is connected by a pivot 9 to plunger 7*a* of seat hydraulic cylinder 7, the other end of which is connected by a pivot 8 to seat base 1. If only a single hydraulic cylinder 7 is sufficient and can be utilized it is disposed in a central position beneath seat 5. If weight and other considerations dictate the need for a pair of seat hydraulic cylinders, then cylinder 7 is disposed proximate one side of seat 5, and a second hydraulic cylinder, similar to cylinder 7 is connected by pivots, similar to pivots 8 and 9 and by an ear, similar to ear 3*a*, proximate the opposite side of seat 5**.

Hydraulic cylinder (or cylinders) 7 are suitably and conventionally connected to a source of hydraulic fluid, through suitable and conventional controls to permit selective extension of plunger **7*a* from cylinder 7 and selective retraction of plunger 7*a* into cylinder 7**.

A seat back 13 is connected to an extension of seat base 1 by a back member 14 pivotally connected at 15 to the extension of seat base 1. A back connector 17 is pivotally connected to a lug **4*a* suitably secured to armrest 4. If desired, there can be a back connector 17 and lug 4*a* on each side of seat 5**.

A footrest link 16 is disposed beneath seat 5 with a first one of its ends pivotally connected to base 1 by pivot 15, and the other of its ends connected by a pivot 18 to footrest 6. If a single footrest link 16 is utilized then it is centrally disposed beneath seat 5; however, if weight or other considerations dictate then a pair of links 16 are utilized and disposed in spaced relationship one with respect to the other beneath seat 5.

Barber/beauty chair of seating 10 is usually disposed in its upright position as shown in FIG. 1 (and in solid lines in FIG. 3). Plunger **7*a* is retracted into plunger 7, seat back 13 is up and footrest 6** is down.

After a person is seated in the chair the barber/beautician operates the controls to raise plunger 2 to position the person at an appropriate height. The chair is rotated to position the seated person with their back to a sink. Then the controls are operated to extend plungers **7*a* from hydraulic cylinders 7. As plungers 7*a* move, cylinder 7 rotates clockwise (FIG. 1) about pivot 8 and seat plate 3 moves in an upward and rearward direction. The upward and rearward movement of seat plate 3 is dictated by the connection of seat plate 3 to link plates 10** through pivots 12, and by link plates 10 through pivots 11 to base 1.

As seat plate 3 and seat 5 move up and towards the rear the pivotal connection of seat back 13, through lug 4*a*, connector 17 and back member 14, rotates in a counter-clockwise direction. Counter-clockwise rotation of seat back 13 moves footrest link 16 in a forward direction to raise footrest 6.

Thus, upon actuation of hydraulic cylinders 7 and extension of plungers 7*a* thereof seat 5, backrest 13 and footrest 6 are moved from their upright position (FIG. 1) to their reclined position (FIG. 2). Subsequent actuation of hydraulic cylinders 7 to retract plungers 7*a* will move seat 5, back 13, and footrest 6 back from their reclined position (FIG. 2) to their upright position (FIG. 1).

From the above description it will thus be seen that their has been provided novel and improved seating for use in a beauty or barber shop or the like; which seating is readily moved between upright and reclined positions in a smooth and efficient manner by a relatively simple hydraulically operated linkage mechanism.

It is my understanding that although I have shown the preferred form of my invention that various modifications may be made in the details thereof without departing from the spirit as comprehended by the following claims.

It thus will be seen that there is provided a barber/-beauty chair for barber shops and beauty parlors which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto and thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

I claim:

1. A beauty/barber chair with movable seatback seat and footrest, providing comfort for a human body in all chair's positions comprising:

(a) seat base means;

(b) seat plate means;

(c) seat linkage means connecting said seat plate means to said seat base means and so as to move said seat plate means between a first position with respect to said seat base means and a second position with respect to said seat base means;

(d) seat means carried by said seat plate means and movable therewith between said first position and said second position;

(e) said seat means including a footrest;

(f) seat back means pivotally connected to said seat base means and pivotably connected to said seat plate means and movable thereby so that movement of said seat means between said first position and said second position moves said seat back means between a first seat back position and a second seat back position;

(g) footrest linkage means connected to said seat back means and to said footrest to move said footrest between a first footrest position and a second footrest position upon movement of said seat back means moving between said first seat back position and said second seat back position; and (h) hydraulic means carried by said seat base means and pivotally connected to said seat plate means and having plunger means extendable to move said seat plate means, said seat linkage means, said seat means, said seat back means and said footrest from said first positions thereof to said second positions thereof;

(i) said plunger means being retractable to move said seat plate means, said seat linkage means, said seat means, said seat back means and said footrest means from said second positions thereof to said first positions thereof.

2. The barber/beauty chair of claim 1, wherein said seat linkage means includes at least one pair of link plates each pivotally connected at a first one of their respective ends to said seat base means, and each pivotally connected at a second one of their respective ends to said seat plate means.

3. The barber/beauty chair of claim 2, wherein each link plate of said pair of link plates are arranged in the same plane and spaced one from the other.

4. The barber/beauty chair of claim 3, wherein there are two pairs of said link plates, a first one of said pairs of link plates being disposed to one side of said seat plate means and said seat base means, and a second one of said pairs of link plates being disposed to the other side of said seat plate means and said seat base means.

5. The barber/beauty chair of claim 1, wherein said plunger means includes a pair of plungers each connected to one side of said seat base means.

6. The barber/beauty chair of claim 1, wherein said footrest linkage means includes a pair of footrest links disposed in spaced relationship one to the other and each proximate another side of said seat base means.

7. The barber/beauty chair of claim 1, wherein at least one armrest is secured to said seat plate means and is pivotally connected to said seat back means so that movement of said seat plate means between said first and said second positions thereof moves said seat back means between said first and said second positions thereof.

8. The barber/beauty chair of claim 7, wherein said second armrest is secured to said seat plate means in spaced relationship to said first armrest, and said second armrest is pivotally connected to said seat back means.

9. The barber/beauty chair of claim 1, wherein said seat means, said seat back means and said footrest in said second positions thereof form a bed like reclining position for the barber/beauty chair and any person seated therein.

10. The barber/beauty chair of claim 1, wherein said seat base means is disposed on top of hydraulic cylinder means.

* * * * *